US005277638A

United States Patent [19]

Lee

[11] Patent Number: 5,277,638

[45] Date of Patent: Jan. 11, 1994

[54] METHOD FOR MANUFACTURING FIELD EMISSION DISPLAY

[75] Inventor: Kangok Lee, Suwon, Rep. of Korea

[73] Assignee: Samsung Electron Devices Co., Ltd., Rep. of Korea

[21] Appl. No.: 991,861

[22] Filed: Dec. 15, 1992

[30] Foreign Application Priority Data

Apr. 29, 1992 [KR] Rep. of Korea ..... 92-7272

[51] Int. Cl.[5] ..... H01J 9/02

[52] U.S. Cl. ..... 445/24; 445/50

[58] Field of Search ..... 445/24, 50

[56] References Cited

U.S. PATENT DOCUMENTS 4,908,539 3/1990 Meyer ..... 315/169.3

4,968,382 11/1990 Jacobson et al. ..... 445/24 X

FOREIGN PATENT DOCUMENTS 61-221783 10/1985 Japan .

*Primary Examiner*—Kenneth J. Ramsey

*Attorney, Agent, or Firm*—Christie, Parker & Hale

[57] ABSTRACT

A field emission display FED is manufactured by a method for manufacturing the FED comprising the steps of forming successively a conductive coating and first photoresist coating on a transparent insulating substrate; exposing the first photoresist coating to the light and removing it except a part where a microtip is formed; etching in a predetermined depth the conductive coating using the first photoresist pattern as a mask to form a plurality of columns; depositing an insulating coating on the etched and exposed conductive coating and removing the remaining first photoresist pattern by a lift off method; depositing and patterning a second photoresist coating on the exposed column and the insulating coating to form a second photoresist pattern in order that the thickness of the remaining second photoresist coating becomes smaller than that of the exposed column; etching the column through a selective isotropic or anisotropic etching process using the second photoresist pattern as the mask to form the sharp end of the microtip; and depositing a gate layer on the insulating coating and removing the remaining second photoresist pattern. As a result, the end of the microtip is formed under the surface of the gate so as to be less influenced by an ion bombardment thereby reducing the abrasion of the microtip.

6 Claims, 4 Drawing Sheets

METHOD FOR MANUFACTURING FIELD EMISSION DISPLAY

BACKGROUND OF THE INVENTION (1) Field of the Invention

The present invention relates to a method for manufacturing a field emission display (below FED) and, more specifically a method for manufacturing a field emission display which can obtain good light emission characteristics by forming cathodes simply and in the uniform height.

(2) Description of the Prior Art

A field emission display FED is a kind of flat display provided with tip-type or wedge-type, cathodes and anodes with a layered phosphor. An electron emitted from a certain cathode strikes the phosphor, so that the phosphor is excited to emit the light thereby displaying patterns, characters or signs. Also, despite minimum voltage consumption, color patterns with high resolution and brightness can be displayed.

A conventional FED of microtip-type disclosed in U.S. Pat. No. 4,908,539 and JP unexamined Publication No. Sho 61-221783 will be described in connection with FIG. 3.

Gates 3 of the rows of electrodes which are divided by cathode patterns 2 and insulating coatings 4 and have a plurality of holes 30 are disposed on a back glass substrate 1 in the cross shape. A plurality of cells 5 are formed on the cross parts. In the cell 5, the same number of microtips 6 as that of holes 30 are formed on the cathode pattern 2. Spacer 7 covering each cell 5 is disposed on the top side of the cell 5. In the meantime, an Indium Tin oxide ITO transparent conductive coating 9 forming an anode electrode and a phosphor coating 10 are formed on the bottom side of a front glass substrate 8.

FIG. 4 describes in an enlarged sectional view the above FED cell 5. As shown in this figure, the microtip 6 is a cathode of a cool cathode using a high electric field emission. Its end is pointed as a tip-type. Even though a lower voltage is applied to the tiny area, electrons are emitted from the end of the tip-type cathode thereby exciting the phosphor 10 facing the cathode.

Namely, electron emission is solicited from a plurality of microtips 6 formed on the cathode pattern 2 and electrons therefrom strike the phosphor 10 through the gates 3 converging the electric field. So, the phosphor 10 is stimulated so as for electrons to be excited. Using the light generated therefrom, the needed picture display can be performed.

In the meantime, the above FED microtip is formed by a process comprising steps shown in FIGS. 5A to 5F.

As shown in FIG. 5A, on the back glass substrate 1, the cathode pattern 2, the insulating coating 4 and the gate 3 are successively formed. As shown in FIG. 5B, a certain portion of the gate 3 is etched by a dry etching to form a hole of the diameter of about 1.4 μm. As shown in FIG. 5C, the insulating coating 4 is etched by a silica etching to form a cavity 40 under the hole 30. As shown in FIG. 5D, with the rotation of the back glass substrate 1, the electron beams are deposited in the projecting angle of 5°-25° to form a nickel layer 11. As shown in FIG. 5E, as well as FIG. 5D, with the rotation of the back glass substrate 1, Mo is deposited on the inner surface of the cavity 40 of the insulating coating 4 to form the microtip 6. After that, as shown in FIG. 5F, Mo deposition 12 with the Ni layer 11 formed on the top of the gate 3 is removed.

Also, a spacer 7 is formed on the whole area of the gate 3 of the back glass substrate 1 except the cell part 5. On the top side of the spacer 7, the front glass 8 on which the transparent conductive film 9 and the phosphor coating 10 are formed are disposed, thereby completing the FED.

However, the microtip 6 formed therefrom, can be easily damaged due to an ion bombardment that, when the electron emitted from the tip excites the phosphor, the positive ion abrades the cathode. As a result, according to the abrasion, the efficiency of electron emission becomes reduced so as not to maintain the stable picture quality thereby shortening the useful life.

Also, when depositing the Ni layer 11 on the gate 3, because the projecting angle of a depositing device (not shown) is modulated with rotating the glass substrate 1, the projecting angle of the depositing device is changed according to the position on the substrate, resulting in the non-uniform tip shapes.

Accordingly, the electron emission force formed on the tip portion becomes non-uniform resulting in the non-uniform brightness. Also, this method has difficulties in forming a plurality of tips at the appropriate uniform height due to the necessary high technology during manufacturing process as well as performing the complicated process.

The above problems act as a big defect when manufacturing a large FED. The combining force of the cathode tip exciting the electron emission with the cathode electrode is weak because, during the manufacturing process of the FED, in each etching step, the etchant is penetrated into the contacting portion of the cathode tip and the cathode electrode, so that, at the time of driving, the cathode tip is dropped out resulting in the reduced manufacturing efficiency.

SUMMARY OF THE INVENTION

One object of the present invention is to provide a method for manufacturing a field emission display FED which can for many hours resist an ion bombardment by disposing cathodes of tip type where microtips are united with cathode electrodes into one and which have the uniform height under gates and forming the sharp end of the microtips.

Another object of the present invention is to provide a method for manufacturing the FED which can manufacture cathodes efficiently and uniformly in order to obtain the uniform and good light emission characteristic.

To achieve the above-mentioned objects, the present invention provides a method for manufacturing the FED including the following steps of:

forming successively a conductive coating and a first photoresist coating on a transparent insulating substrate;

exposing the first photoresist coating to the light and removing it except for a part where a microtip is formed;

etching in a predetermined depth the conductive coating by interposing the first photoresist pattern as a mask to form a plurality of columns;

depositing an insulating coating on the etched and exposed conductive coating and removing the remaining first photoresist pattern by a lift off method;

depositing and patterning a second photoresist coating on the exposed column and the insulating coating to form a second photoresist pattern in order that the thickness of the remaining second photoresist pattern is smaller than that of the exposed column;

etching the column through a selective isotropic or anisotropic etching process by interposing the second patterned photoresist as the mask to form the sharp end of the microtip; and depositing a gate layer on the insulating coating and removing the remaining second photoresist pattern.

BRIEF DESCRIPTION OF THE DRAWINGS

Other objects and further advantages of the present invention will be apparent from the following detailed description in connection with the accompanying drawings, in which.

DETAILED DESCRIPTION OF THE PREFERRED EMBODIMENT

Figure 1:
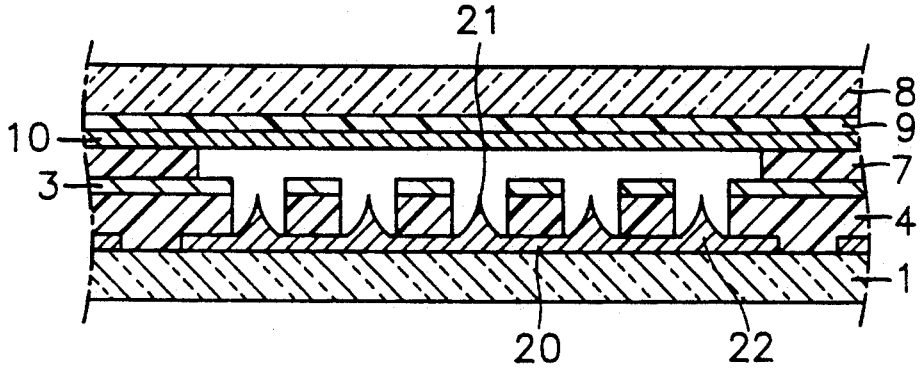
FIG. 1 is a sectional view of a field emission display FED of the present invention.
Figure 4:
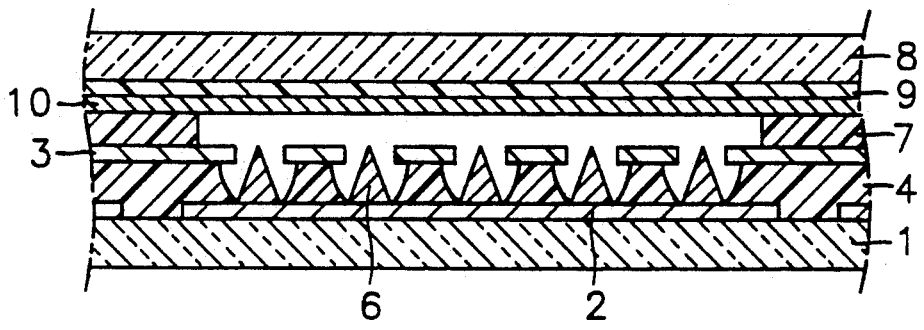
FIG. 4 (Prior Art)
FIG. 4 is a sectional view of a conventional FED.
Figure 2A:
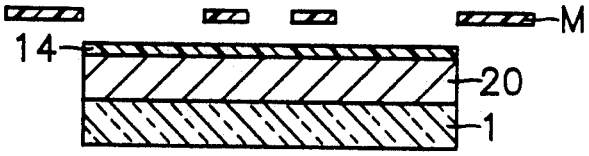
FIGS. 2A to 2G illustrate the steps in the manufacture of the FED.
Figure 2B:
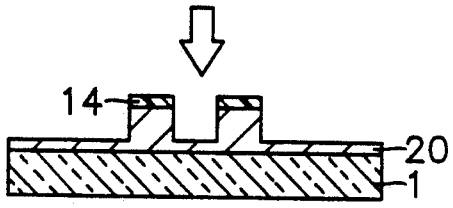
Figure 2C:
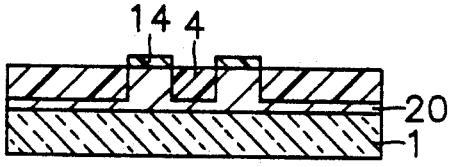
Figure 2D:
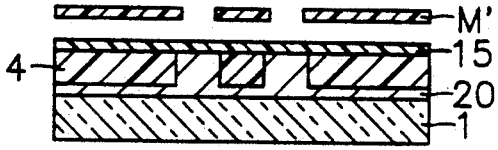
Figure 2E:
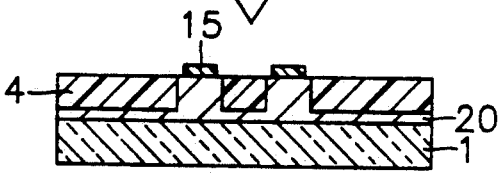
Figure 2F:
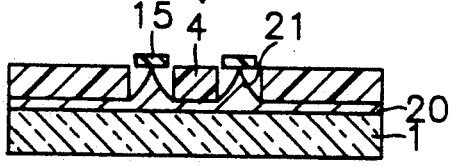
Figure 2G:
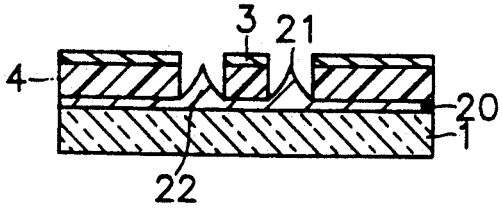
Figure 3:
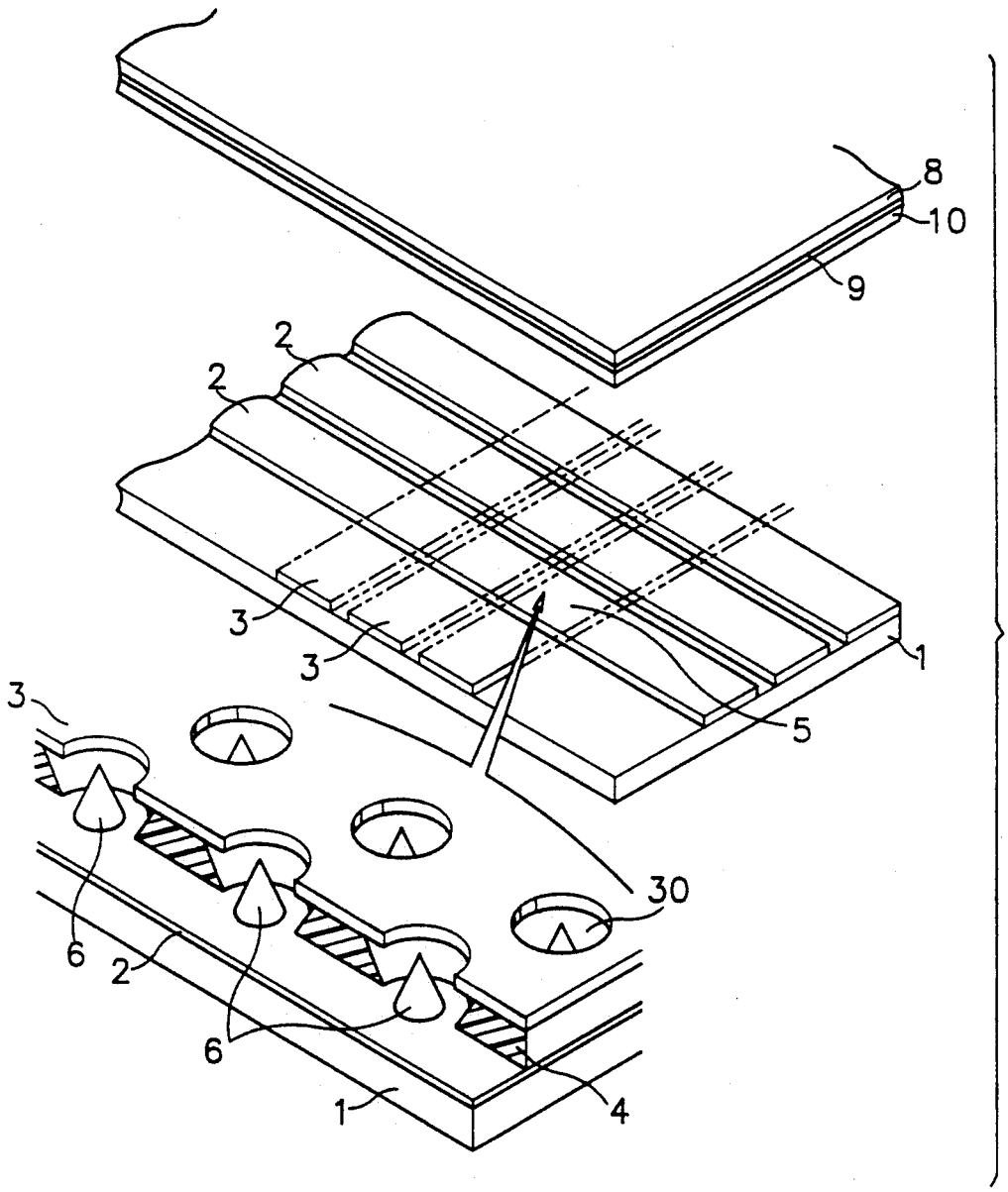
FIG.3 (Prior Art)
FIG. 3 is a perspective view of a general FED of microtip type.
Figure 5A:
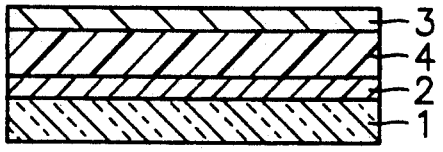
FIG.5A (Prior Art)
FIGS. 5A to 5F illustrate the steps in the manufacture of a conventional FED.
Figure 5B:
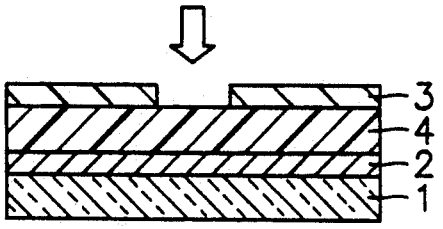
FIG.5B (Prior Art)
Figure 5C:
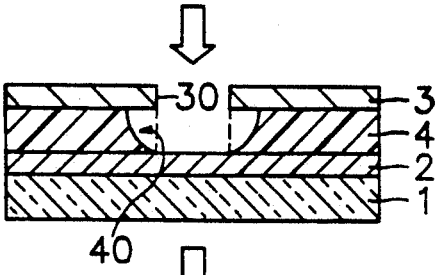
FIG.5C (Prior Art)
Figure 5D:
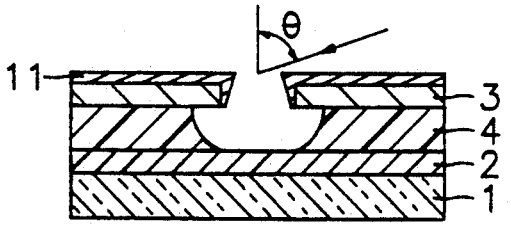
FIG.5D (Prior Art)
Figure 5E:
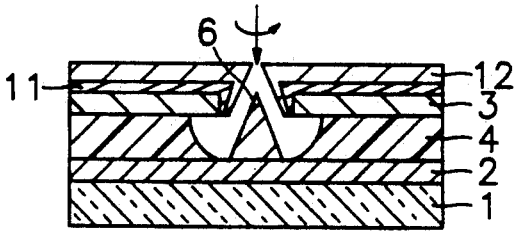
FIG.5E (Prior Art)
Figure 5F:
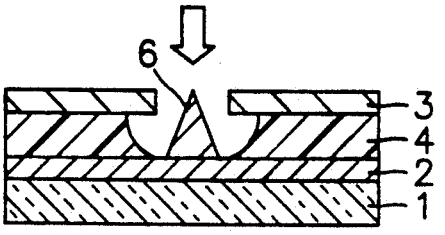
FIG.5F (Prior Art)

FIG. 1 describes in a sectional view a field emission display FED formed according to a manufacturing process shown in FIGS. 2A to 2G wherein the same reference numerals are applied to the same parts as those shown in FIGS. 3 and 4 in order to avoid repeated explanation of the drawings.

Description of the manufacturing process of the FED of the present invention follows that of the characteristics of the FED obtained from the present invention.

As shown in FIG. 1, the FED of the present invention has a cathode 22 formed by uniting a cathode electrode 20 constituting a column electrode with a microtip into one; a back glass substrate 1 in which a gate 3 forming a row electrode is divided by an insulating coating 4 and cells are formed on the crossing part of the cathode 22 and the gate 3 by a matrix method; spacer 7 which is formed on the whole part except the cells; and a front glass substrate 8 on which an ITO transparent conductive layer 9 and a phosphor coating 10 are deposited. The microtips 21 which are of uniform height are disposed under the gate 3 to the extent of the thick height of the gate 3. The peripheral inclined area of the tip is concavely rounded to form the sharp end thereof. The end of microtip 21 is disposed under gate 3 and the sharp end thereof is longer than that of a conventional one, resulting in not only the possible lower voltage driving but also the longer useful life against the abrasion caused by an ion bombardment.

Also, the cathode 22 is formed by uniting the microtip 21 with the cathode electrode 20 into one whereby, during the manufacturing process, the microtip 21 can not be dropped out from the cathode electrode 20.

FIGS. 2A to 2G show a method for manufacturing the FED of the present invention.

As shown in FIG. 2A, a conductive layer 20 is deposited on the top side of the back glass substrate 1. The conductive layer 20 is made of Si or metal such as Ta and the like. A first photoresist coating 14 is coated thereon. And then, interposing a photo mask M, a predetermined part is exposed to the light and etched to make a pattern for the first photoresist coating.

As shown in FIG. 2B, interposing the first photoresist pattern 14 as a mask, the exposed conductive coating 20 is etched at a predetermined depth and removed. At that time, the non-etched conductive coating 20 forms a column.

As shown in FIG. 2C, after the insulating coating 4 formed by $SiO_2$ is formed in the above etched space using an electron beam depositing device or a sputter device, the remaining first photoresist pattern on the conductive layer 20 is remove lift off method.

As shown in FIGS. 2D and 2E, a second photoresist coating 15 is deposited on the column conductive coating 20 and the insulating coating 4. Interposing the mask M', the second photoresist coating 15 is exposed to the light to form a second photoresist pattern having a smaller area than that of the projected conductive coating 20. A non-exposed part of the second photoresist pattern is etched.

And then, as shown in FIG. 2F, the projected conductive coating 20 is etched by an isotropic etching process which etches in the same ratio (50:50) of the vertical direction to the horizontal directional and an anisotropic etching process which etches in the different ratio thereof to form the microtip 21. At that time, the non-projected conductive coating corresponds to the cathode electrode.

As shown in FIG. 2G, Mo, W or Nb is deposited on the insulating coating 4 to form the gate 3. The second photoresist pattern 15 is removed by the lift off method to form the cathode of one body.

The spacer 7 is formed on whole area except the cell where the cathode 22 is placed on the back glass substrate 1.

The front glass 8 on which the transparent conductive coating 9 and the phosphor coating 10 are formed is placed on the spacer 7. And then, the above elements are united into one to complete the FED.

As described above, the cathode is formed according to the simple photoresist method, so that, since the high technology in the embodiment of the process is not needed, the manufacturing process is simple. Also, the heights of the microtips are uniform, so that the gate voltages applied to the microtips are uniform so as to obtain the good light emission characteristic.

Thus, according to the FED of the present invention, the microtips of the cathode emitting the electrons are disposed in the uniform height under the gate and sharply formed by being united with the cathode so as to resist the ion bombardment for hours and obtain the good and uniform light emission characteristic. Also, the present invention has advantage of simply and efficiently manufacturing the above cathode.

What is claimed is:

1. A method for manufacturing a field emission display FED comprising the steps of:

forming successively a conductive coating and a first photoresist coating on a transport insulating substrate;

exposing the first photoresist coating to the light and removing the first photoresist coating except for a part where a microtip is formed;

etching a predetermined depth in the conductive coating by interposing the first photoresist pattern as a mask to form a plurality of columns;

depositing an insulating coating on the etched and exposed conductive coating and removing the remaining first photoresist pattern by a lift off method;

depositing and patterning a second photoresist coating on the exposed columns and the insulating coating to form a second photoresist pattern so that the thickness of the remaining second photoresist pattern become smaller than that of the exposed columns;

etching the columns through a selective isotropic or anisotropic etching process by interposing the second photoresist pattern as the mask to form the sharp end of a microtip; and depositing a gate layer on the insulating coating and removing the remaining second photoresist pattern.

2. The method for manufacturing the FED as claimed in claim 1, wherein the conductive coating comprises Si or metal such as Ta and the like and is formed in the thickness of 10000 Å to 20000 Å.

3. The method for manufacturing the FED as claimed in claim 1, wherein the etching of the conductive coating for forming the column is performed by an anisotropic etching method.

4. The method for manufacturing the FED as claimed in claim 1, wherein the height of the column is 7000 Å to 15000 Å.

5. The method for manufacturing the FED as claimed in claim 1, wherein the peripheral inclined area of the microtip is inward rounded.

6. The method for manufacturing the FED as claimed in claim 1, wherein the gate layer comprises Mo, W, or Nb is formed in the thickness of 1000 Å to 4000 Å.

* * * * *

UNITED STATES PATENT AND TRADEMARK OFFICE

CERTIFICATE OF CORRECTION

PATENT NO. : 5,277,638

DATED : January 11, 1994

INVENTOR(S) : Kangok Lee

It is certified that error appears in the above-indentified patent and that said Letters Patent is hereby corrected as shown below:

Column 3, line 8, change "patterned photoresist" to -- photoresist pattern --.
Column 3, line 36, before "drawings" insert -- same elements in the --.

Column 4, line 14, change "remove" to -- removed by a --.
Column 4, line 26, change "directional" to -- direction --.
Column 4, line 35, before "whole" insert -- the --.
Column 4, line 55, before "advantage" insert -- the --.

Column 6, line 14, change "inward" to -- inwardly --.

Signed and Sealed this

Twenty-first Day of November, 1995

*Attest:*

Bruce Lehman

BRUCE LEHMAN

*Attesting Officer*

*Commissioner of Patents and Trademarks*